US008561243B2

(12) United States Patent
Osaland

(10) Patent No.: US 8,561,243 B2
(45) Date of Patent: Oct. 22, 2013

(54) CLEANING TOOL DEVICE

(75) Inventor: Espen Osaland, Sandnes (NO)

(73) Assignee: Aker Well Service AS, Stavanger (NO)

( * ) Notice: Subject to any disclaimer, the term of this patent is extended or adjusted under 35 U.S.C. 154(b) by 56 days.

(21) Appl. No.: 12/863,407

(22) PCT Filed: Jan. 13, 2009

(86) PCT No.: PCT/NO2009/000017

§ 371 (c)(1),
(2), (4) Date: Jan. 19, 2011

(87) PCT Pub. No.: WO2009/091263

PCT Pub. Date: Jul. 23, 2009

(65) Prior Publication Data

US 2011/0107535 A1 May 12, 2011

(30) Foreign Application Priority Data

Jan. 16, 2008 (NO) ..... 20080305

(51) Int. Cl.
*B08B 9/02* (2006.01)

(52) U.S. Cl.
USPC ..... 15/104.05; 15/104.09; 15/104.095

(58) Field of Classification Search
USPC ..... 15/104.05, 104.09, 104.095, 15/104.12–104.14, 104.31
See application file for complete search history.

(56) References Cited

U.S. PATENT DOCUMENTS 743,782 A * 11/1903 Weinland ..... 15/104.13
759,468 A * 5/1904 Prentice ..... 15/104.13
1,133,262 A * 3/1915 Casaday ..... 15/104.13
1,205,230 A * 11/1916 Lufkin ..... 15/104.13
1,611,071 A * 12/1926 Reed ..... 15/104.13
2,025,009 A * 12/1935 Baker ..... 15/104.13
2,189,030 A * 2/1940 Harrington ..... 175/346
3,436,362 A 4/1969 Hayer et al.
4,141,421 A * 2/1979 Gardner ..... 175/263
4,921,046 A * 5/1990 Caskey ..... 166/170

(Continued)

FOREIGN PATENT DOCUMENTS

CN 1613900 A 5/2005
DE 1 569 014 4/1970

(Continued)

OTHER PUBLICATIONS

Schiller, Michael et al., "Photo-Physics of Surface-Treated Titanium Dioxides", Journal of Photochemistry and Photobiology A: Chemistry 149 (2002) 227-236.
International Search Report for PCT/EP2009/050648 dated Jun. 7, 2009.
German Office Action dated Feb. 9, 2009.

*Primary Examiner* — Monica Carter
*Assistant Examiner* — Michael Jennings
(74) *Attorney, Agent, or Firm* — Finnegan, Henderson, Farabow, Garrett & Dunner, L.L.P.

(57) ABSTRACT

A cleaning tool device (1) for a pipe (10), the cleaning tool (1) being moved internally in the pipe (10) while rotating about substantially the center axis (12) of the pipe (10), and the cleaning tool (1) being provided with a leading cleaning body (2) at its free end portion (4), and there being arranged, close behind the free end portion (4), a tool support (6) which is arranged to bear on the internal jacket surface (16) of the pipe (10), the tool support (6) being provided with at least one rotatable support cleaning body (8', 8'', 8''' and 8'''').

7 Claims, 4 Drawing Sheets

(56) References Cited

U.S. PATENT DOCUMENTS

| | | | | |
|---|---|---|---|---|
| 4,967,841 | A * | 11/1990 | Murray | 166/312 |
| 5,363,530 | A * | 11/1994 | Dunn et al. | 15/236.08 |
| 6,070,285 | A * | 6/2000 | Geppert | 15/104.061 |
| 6,194,494 | B1 | 2/2001 | Wehner et al. | |
| 6,530,429 | B2 * | 3/2003 | Howlett | 166/173 |
| 6,575,239 | B2 * | 6/2003 | Allen | 166/170 |
| 6,820,653 | B1 * | 11/2004 | Schempf et al. | 138/98 |
| 7,077,981 | B2 | 7/2006 | Wehner et al. | |
| 7,358,286 | B2 | 4/2008 | Hopfmann et al. | |
| 7,454,812 | B1 * | 11/2008 | Lyle | 15/104.05 |
| 2009/0306257 | A1 | 12/2009 | Wehner et al. | |
| 2011/0107535 | A1 * | 5/2011 | Osaland | 15/104.09 |

FOREIGN PATENT DOCUMENTS

| | | | |
|---|---|---|---|
| DE | 1 954 273 | | 5/1970 |
| DE | 1 694 873 | | 8/1970 |
| DE | 103 01 675 | A1 | 7/2004 |
| DE | 10 2004 037 369 | A1 | 3/2006 |
| EP | 0 736 569 | A1 | 10/1996 |
| EP | 0 768 336 | A2 | 4/1997 |
| GB | 1077108 | | 7/1967 |
| GB | 1 244 685 | | 9/1971 |
| WO | WO 02/072684 | A1 | 9/2002 |
| WO | WO 2007067066 | A1 * | 6/2007 |

* cited by examiner

III-III

CLEANING TOOL DEVICE

BACKGROUND OF THE INVENTION

A cleaning tool is provided. More particularly, it is a cleaning tool for a pipe, the cleaning tool being moved internally in the pipe while rotating about substantially the centre axis of the pipe, and the cleaning tool being provided with a leading cleaning body at its free end portion, and there being arranged, close behind the free end portion, a tool support which is arranged to bear on the internal jacket surface of the pipe.

In the further description the cleaning of a pipe with deposits is taken as a basis, as such an operation adequately accentuates the advantageous features of the cleaning tool. However, the area of application of the cleaning tool is in no way limited to such work, as it will be usable for a number of operations in which a pipe or borehole is to be cleaned or extended and in which a so-called "pilot hole" is present.

During the operation of pipe facilities of different kinds it is well known that over time deposits may build up on the internal jacket surface of the pipe. This is particularly unfortunate in the case of long pipes to which access is difficult and in which chemical cleaning methods are not very effective.

Norwegian patent 320906 discloses a tool which by rotating tilted brushes in a pipe causes the brushes to be imparted an axial, oscillating movement relative to the pipe wall. U.S. Pat. No. 20255009 deals with cleaning bodies which are arranged to be flung out against the pipe wall by means of centrifugal force.

It is known to use a cleaning tool provided with a cleaning body for cleaning a pipe at its free end portion. The cleaning tool is moved along the pipe while being rotated about the longitudinal axis of the pipe. Cleaning tools which are provided with rotatable cleaning bodies have turned out to be effective, the cleaning bodies breaking up deposits when rolling against the internal jacket surface of the pipe. Norwegian patent 324515 and U.S. Pat. No. 2,150,806 disclose cleaning tools of this kind.

To reduce the risk of a cleaning tool sticking in the pipe, among other things, the external work diameter of cleaning bodies is somewhat smaller than the diameter of the internal jacket surface of the pipe. Experience has proved that because of uneven deposit thickness, for example, the cleaning tool may be moved out somewhat in a radial direction from the longitudinal axis of the pipe, whereby a helical opening is formed within the pipe.

During subsequent work in the pipe the somewhat helical opening within the pipe may cause tools to get stuck.

It is known to provide the cleaning tool with a tool support close behind the free end portion to counteract the formation of a helical opening. The tool support is arranged to bear on the internal jacket surface of the pipe.

Prior art tool supports are typically formed with sliding bodies, possibly with a scraping blade which bears on the internal jacket surface. The scraping blade is arranged to further clean deposits from the internal jacket surface of the pipe. Prior art tool supports have turned out to be relatively ineffective.

The invention has for its object to remedy or reduce at least one of the drawbacks of the prior art.

The object is achieved according to the invention through the features which are specified in the description below and in the claims that follow.

BRIEF SUMMARY OF THE INVENTION

A cleaning tool for a pipe is provided, the cleaning tool being moved internally in the pipe while rotating about substantially the centre axis of the pipe, and the cleaning tool being provided with a leading cleaning body at its free end portion, and there being arranged, close behind the free end portion, a tool support which is arranged to bear on the internal jacket surface of the pipe. The cleaning tool is characterized by the tool support being provided with at least one rotatable support cleaning body.

The support cleaning body is arranged to rotate about a rotary axis in a rolling manner against the internal jacket surface of the pipe. The support cleaning body may be provided with an even or uneven external surface, possibly a combination thereof.

An aspect of the cleaning tool is that the tool support is provided with at least two support cleaning bodies.

Another aspect of the cleaning tool is that the surface pattern of at least one of the support cleaning bodies is different from the surfaces of the other support cleaning bodies, possibly that the surface pattern of at least one of the support cleaning bodies is different from the surface pattern of at least one of the leading cleaning bodies.

By the surface of a support cleaning body including a number of grooves with intermediate, relatively sharp, ridges, the ridges radially surrounding the cleaning body, whereas the ridges extend axially or helically along another one of the cleaning bodies, the cooperation between cleaning bodies with different surface patterns may contribute, during the cleaning operation, to breaking up the deposits.

The surface of the support cleaning body may comprise a number of cones or pyramids.

In a cleaning operation, when the cleaning tool is moved inwards in the pipe while rotating about the centre axis, unevenness in the deposit will seek to move the free end portion of the cleaning tool out from the centre axis. Thereby at least one support cleaning body is brought into contact with the internal jacket surface of the pipe, counteracting a further radial displacement of the free end portion.

By the support cleaning body rolling against the jacket surface, a relatively small torque is required to drive the tool support.

A further internal cleaning of the pipe is achieved by the at least one support cleaning body being formed with appropriate surface patterns as it is described above.

The cleaning tool can be driven by means of, for example, a downhole tractor, a drill pipe or coiled tubing.

A cleaning tool is provided, in which the tool support is provided with at least one rotatable support cleaning body, whereby a cleaning operation may be carried out with a considerably reduced need for torque as compared with cleaning tools which are provided with prior art tool supports.

BRIEF DESCRIPTION OF THE DRAWINGS

In what follows is described an example of a preferred embodiment which is visualized in the accompanying drawings, in which.

THE DETAILED DESCRIPTION

Figure 1:
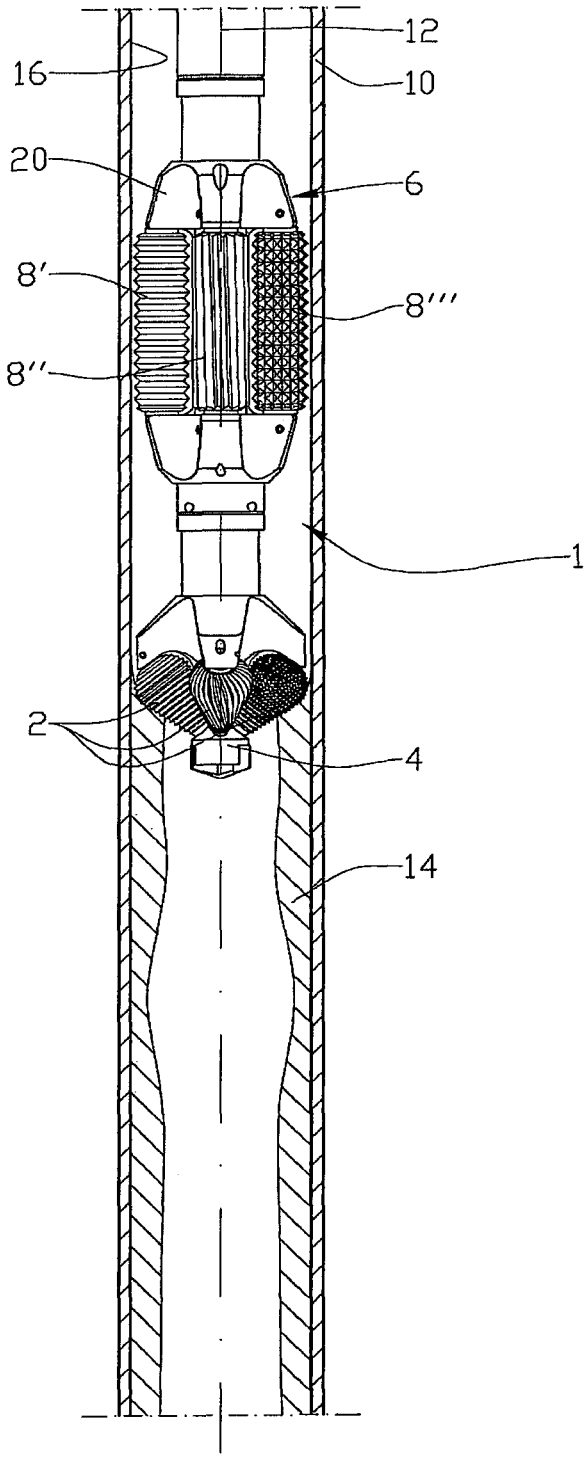
FIG. 1 shows a cleaning tool with a tool support working in a pipe.
Figure 2:
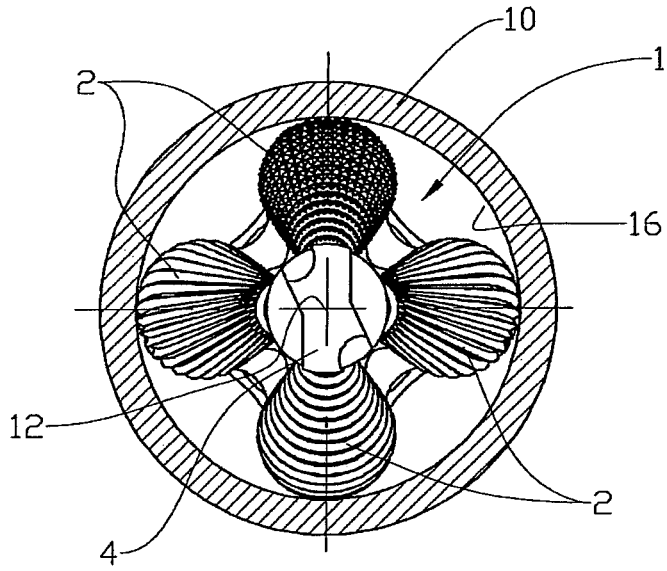
FIG. 2 shows, on a larger scale, an end view of the cleaning tool in the pipe.
Figure 3:
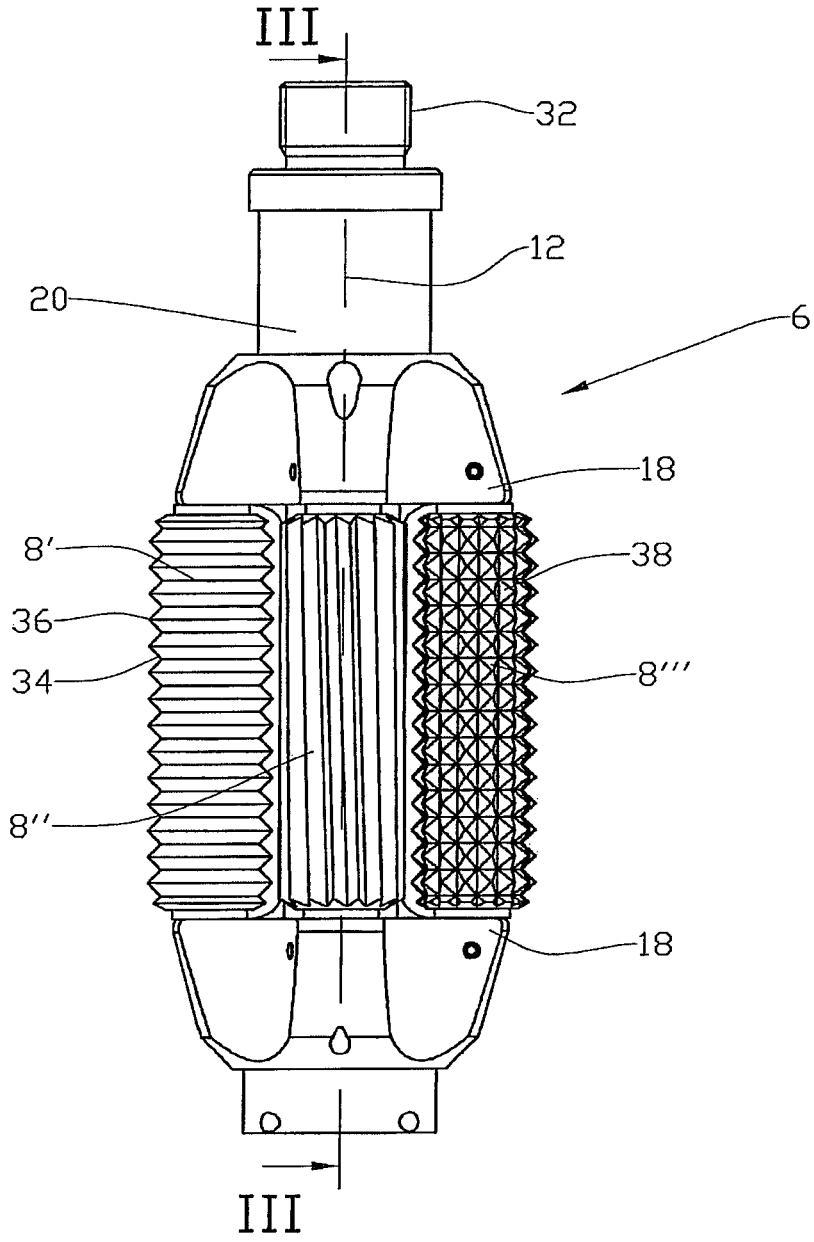
FIG. 3 shows, on a larger scale, a side view of the tool support of FIG. 1.
Figure 4:
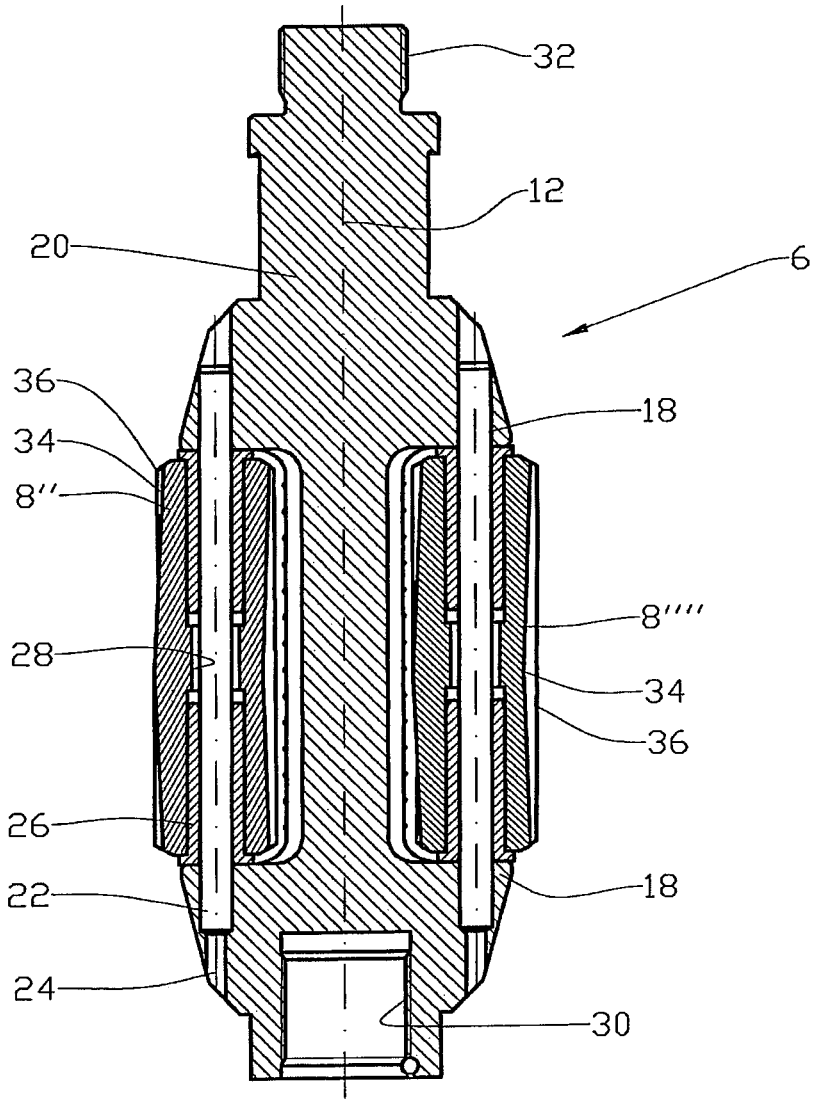
FIG. 4 shows a section III-III of FIG. 3.

In the drawings the reference numeral 1 indicates a cleaning tool including four rotatable leading cleaning bodies 2 of a design known per se, which are arranged at the free end portion 4 of the cleaning tool 1, and a tool support 6 which is provided with first, second, third and fourth support cleaning bodies, indicated by 8', 8", 8''' and 8'''' respectively. The fourth support cleaning body 8'''' is hidden in FIGS. 1 and 3, but is shown in FIG. 4.

The cleaning tool 1 is arranged to be moved in a manner known per se within a pipe 10 while rotating about the centre axis 12 of the pipe 10 to clean away deposits 14, for example, which have deposited on the internal jacket surface 16 of the pipe 10.

The leading cleaning bodies 2, which are rotatable, have been tilted in this preferred exemplary embodiment in such a way that the smallest diameter of the leading cleaning bodies 2 faces to the direction of working and in towards the centre axis 12.

The support cleaning bodies 8', 8", 8''' and 8'''', which have been given a substantially cylindrical shape, are placed between pedestals 18 in the mandrel 20 of the tool support 6.

An axle 22 extend centrically with a rotary axis 24 in bushings 26 in a through opening 28 in the respective support cleaning bodies 8', 8", 8''' and 8'''' between the pedestals 18.

At its end portions, the mandrel 20 is provided with an internal connection thread 30, respectively an external connection thread 32.

The surface of the first support cleaning body 8' comprises a number of grooves 34 with intermediate, relatively sharp, ridges 36 surrounding the first support cleaning body 8'.

The grooves 34 and ridges 36 extend somewhat helically along the surfaces of the second support cleaning body 8" and the fourth support cleaning body 8''''.

The third support cleaning body 8''' is externally provided with a number of pyramids 38.

Thus, the different patterns from ridges 36 and pyramids 38 on the support cleaning bodies 8', 8", 8''' and 8'''' have the effect of imparting to the deposit 14 a relatively fine-meshed groove pattern which contributes to breaking up the deposit 14 in an effective manner. The effect is intensified by co-operation with a possible pattern of the leading cleaning bodies 2.

In a cleaning operation, when the cleaning tool 1 is moved inwards in the pipe 10 while rotating about the centre axis 12, unevenness in the deposit 14 will seek to move the free end portion 4 of the cleaning tool 1 out from the centre axis 12. At least one support cleaning body 8', 8", 8''' and 8'''' is thereby brought into contact with the internal jacket surface 16 of the pipe 10, counteracting a further radial movement of the free end portion 4.

The invention claimed is:

1. A cleaning tool device for a pipe, the cleaning tool being moved internally in the pipe, while rotating about substantially a centre axis of the pipe, the cleaning tool comprising:

a leading cleaning body at a free end portion of the cleaning tool; and a rotatable tool support arranged close behind the free end portion of the leading cleaning body and counteracting radial movement of the free end portion of the leading cleaning body;

wherein the tool support is provided with at least two cylindrical shaped support cleaning bodies, each with a uniform surface pattern, that is rotatable on a longitudinal axis between pedestals of the tool support;

wherein the support cleaning bodies are provided with a bushing in a central through opening in said respective support cleaning bodies, said cylindrical shaped support cleaning bodies exhibit an axial length greater than a diameter of each body;

wherein a surface pattern of at least one of said support cleaning bodies is different from a surface pattern of the other support cleaning bodies; and wherein the at least one support cleaning body is arranged at a distance along a longitudinal axis of the cleaning tool from the leading cleaning body.

2. The device in accordance with claim 1, wherein said tool support is provided with at least three support cleaning bodies.

3. The device in accordance with claim 1, wherein said surface pattern of at least one of said support cleaning bodies is different from a surface pattern of at least one of said leading cleaning bodies.

4. The device in accordance with claim 1, wherein said surface pattern of said support cleaning body includes a number of grooves with intermediate, relatively sharp, ridges.

5. The device in accordance with claim 4, wherein said ridges radially surround said support cleaning body.

6. The device in accordance with claim 4, wherein said ridges extend helically along said support cleaning body.

7. The device in accordance with claim 1, wherein a surface of said support cleaning body includes a number of cones or pyramids.

* * * * *